United States Patent [19]

Von Holdt

[11] Patent Number: 4,735,337

[45] Date of Patent: Apr. 5, 1988

[54] PLASTIC LID HAVING OPENING MEANS

[76] Inventor: John W. Von Holdt, 6864 Lexington La., Niles, Ill. 60648

[21] Appl. No.: 54,423

[22] Filed: May 26, 1987

[51] Int. Cl.[4] ..... B65D 17/40

[52] U.S. Cl. ..... 220/276; 220/270; 215/256

[58] Field of Search ..... 220/270, 276, 306; 215/253, 256

[56] References Cited

U.S. PATENT DOCUMENTS

| | | | |
|---|---|---|---|
| 1,557,653 | 10/1925 | Carvalho . | |
| 2,941,660 | 6/1960 | Tupper . | |
| 3,979,003 | 9/1976 | Allen | 215/256 |
| 4,055,267 | 10/1977 | Blair . | |
| 4,165,018 | 8/1979 | Giggard . | |
| 4,362,253 | 12/1982 | Wortley et al. . | |
| 4,385,708 | 5/1983 | Curry . | |
| 4,488,658 | 12/1984 | Smith et al. | 220/276 |
| 4,669,630 | 6/1987 | Kenyon et al. | 220/276 |
| 4,682,706 | 7/1987 | De Vore et al. | 220/276 |

*Primary Examiner*—George T. Hall

*Attorney, Agent, or Firm*—Charles F. Pigott, Jr.; Garrettson Ellis

[57] ABSTRACT

A plastic lid for a container comprises a lid body and an annular, peripheral gripping flange for retaining the lid on the container. In accordance with this invention, the flange defines at least a pair of spaced, circumferential sections, each section having opposed ends which each define a break-away flange portion. Each spaced section defines means permitting outward folding of the section upon breaking away of the connected break-away flange portions to facilitate opening. Alternatively, the gripping flange may define a zigzag tear line for removal of spaced, enlarged portions of the gripping flange to facilitate opening, while permitting remaining portions of the gripping flange to provide some retention of the lid to its container.

12 Claims, 2 Drawing Sheets

PLASTIC LID HAVING OPENING MEANS

BACKGROUND OF THE INVENTION

For a paint cans and other containers, it is of course desirable for the lid to be easily removable, but at the same time, a good, hermetic seal is often necessary until the lid has been removed. Additionally, there is usually a need for the lid to be reattachable to the container again.

To accomplish this, attempts have been made in the designing of plastic lids with circumferentially tear strips. Such lids can usually only be opened by removal of the circumferential tear strip, following which the lid itself may be removed. See, by way of example, Tupper U.S. Pat. No. 2,941,660; Carvalho U.S. Pat. No. 1,557,653; Blair U.S. Pat. No. 4,055,267; Giggard U.S. Pat. No. 4,165,018; Wortley et al. U.S. Pat. No. 4,362,253 and Curry U.S. Pat. No. 4,385,708.

The above are illustrative of various types of container lids which are openable by tearing, and in some instances folding of parts of the lid.

As a disadvantage of many tear-away lid designs, the lid is not very effective after opening for good reclosing of the container, especially when a tear strip is removed from a substantially 360° section of the retaining flange of the lid.

In accordance with this invention, a container lid is provided which can produce a desired strong, hermetic seal until opened. Nevertheless, the container may be easily opended by means that provide disengagement of some of its retaining flange from the container, to permit such easy opening. However, upon reapplication of the lid to the container, it can still exhibit acceptable closing ability, so that the contents of the container do not spill or evaporate in between uses.

The container lid of this invention is particularly useful for large lids, for example paint bucket lids or lids for similar large containers or drums.

DESCRIPTION OF THE INVENTION

In this invention a plastic lid for a container is provided which comprises a lid body and an annular, peripheral gripping flange for retaining the lid on the container.

In accordance with one aspect of this invention, the flange defines at least a pair of spaced, circumferential sections, each section having opposed ends which each define a break-away flange portion. Each spaced, circumferential section defines means permitting outward folding of the section upon breaking away of the connected break-away flange portions.

Thus, a user, having a screwdriver or the like, can simply break-away the above-described break-away flange portions to release the respective ends of the each of the spaced, circumferential sections. The user then folds these sections upwardly so that the flange portions that they constitute no longer engage the lip of the container. Following this, removal of the container lid is greatly facilitated, and becomes an easy manner.

However, when it is desired to reapply the lid, the remaining portions of the gripping flange which are not folded outwardly may once again engage the lip of the container to provide some retention of the lid on the container. The amount of retention that is desired is of course a matter of the relative proportions of the spaced, circumferential sections which are folded out of engagement with the lip. However, it also is possible for the spaced, circumferential sections to be folded back into engagement with the lip, for added retention of the reclosed lid on the container lip.

Preferably, the annular, peripheral gripping flange defines a substantially continuous, inwardly extending annular gripping projection, which serves to engage an appropriate groove or the like in the container lip for retention of the lid.

Also, the break-away flange portions may be simple folding members which can be torn out of engagement with the gripping flange, but they may also be break-away flange portions to be completely separated from the remainder of the flange.

In another embodiment of this invention, the gripping flange may carry, as defined before, the substantially continuous, inwardly extending annular gripping projection. Additionally, the gripping flange defines a substantially annular upper portion and a substantially annular lower portion, plus circumferential tear line means to permit tearing separation of the lower portion from the upper portion.

In this circumstance, by this invention, the tear line means may define a zigzag path circumferentially about the gripping flange. As a result of this, tearing of the lower portion from the upper portion can cause removal of spaced portions of the annular gripping projection without removing all of the gripping projection. Thus, once again, the lid has been placed in a more easily openable condition, after the lower portion of the gripping flange has been removed. Nevertheless, upon reclosing, some portions of the annular gripping projection remain to provide some retention of the lid to the container lip.

DESCRIPTION OF SPECIFIC EMBODIMENTS

Figures 1, 2, 3, 4:
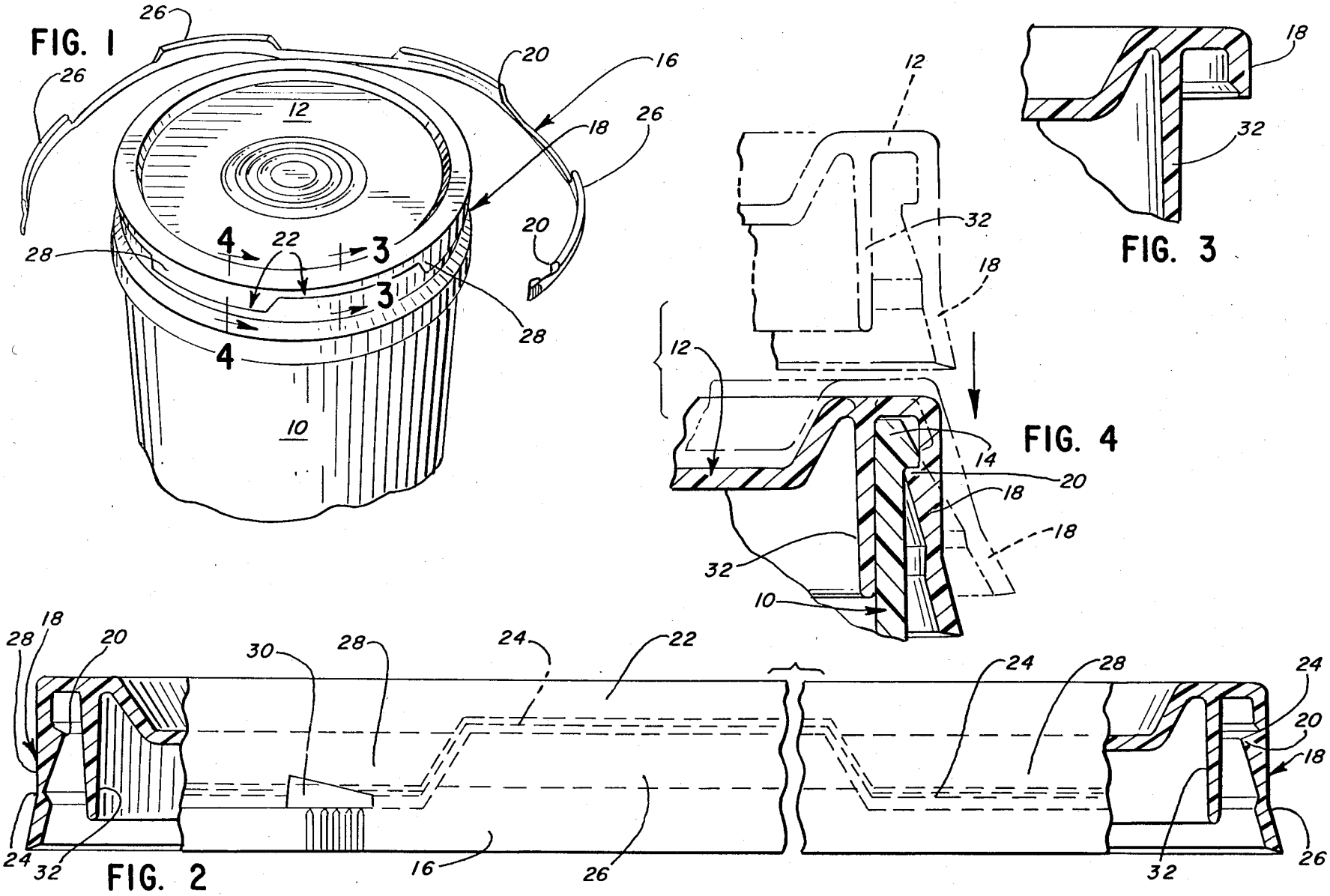
FIG. 1 is a perspective view of one embodiment of the plastic lid of this invention carried on a container, and shown in a partially opened configuration.
FIG. 2 is an elevational view, taken partly in section, showing the plastic lid of this invention in its original configuration.
FIG. 3 is a sectional view taken along line 3—3 of FIG. 1.
FIG. 4 is a sectional view taken along line 4—4 of FIG. 1, showing also how the lid may be applied to the container lip.

Referring to FIGS. 1 through 4, plastic paint bucket or other container 10 is shown to carry a molded plastic lid 12 which has been sealed to the rim 14 of bucket 10.

Tear strip 16, forming part of annular, peripheral gripping flange 18, has been removed which, in turn, permits easy removal of lid 12 from bucket 10. Prior to removal, annular peripherial gripping flange 18 defines a substantially continuous inwardly extending annular gripping projection 20 which can engage a step or the like in lip 14 of bucket 10 as shown in FIG. 4 for firm retention of lid 12 on bucket 10, to provide a good seal and high bucket drop test values.

FIG. 4 also shows how a free, intact lid 12, shown in phantom lines, can be snapped into place on lip 14 of bucket 10. After installation on bucket 10, lid 12 is substantially non-removable except by removal of tear strip 16.

In accordance with this invention, the annular gripping flange 18 defines a circumferential upper portion 22 and a circumferential lower portion 16 which becomes tear strip 16 upon separation thereof from upper portion 22 along an annular, circumferential tear line 24 (FIG. 2). In this invention, annular, circumferential tear line 24 defines a zigzag path circumferentially about gripping flange 18, so that, as tear strip 16 is separated from the rest of gripping flange 18, certain spaced portions 26 which carry portions of annular gripping projection 20 are removed with the tear strip. On the other hand, certain remaining portions 28 of gripping flange 18 which carry spaced portions of gripping projection 20 remain attached to bucket lid 12 as shown for example in FIG. 1. Thus, after tear strip 16 has been removed, bucket lid 12 still remains attached to bucket 10 by the action of remaining portions 28 of the gripping flange, but the lid becomes easily removable. Additionally, after such opening step, lid 12 is reattachable to bucket 10, but in an easily removable manner characteristic of temporary attachment.

Levered opening member 30 may be provided so that one may manually initiate the tearing process of tear strip 16, with lever member 30 being of conventional tear strip design.

Additionally, lid 12 also carries annular retaining flange 32, which is positioned coaxially and radially inwardly from gripping flange 18, in spaced relation thereto, define with gripping flange an annular chamber for receiving container lip 14, as shown in FIG. 4.

Accordingly, the container lid of FIGS. 1 through 4 may be applied to an annular bucket lid 14 by a snap-on pressing process, following which lid 12 is essentially non-removable, except by removal of tear strip 16. Upon removal of tear strip 16 by tearing along zigzag tear line 24 circumferentially about lid 12, segments 26 of gripping flange 18 are removed, along with their corresponding portions of annular gripping projection 20. However, segments 28 of gripping flange 18, which carry sections of gripping projection 20, remain attached to lid 12, to cause a measure of retention capability to remain with lid 12 despite the removal of tear strip 16. Thus, while, after opening of tear strip 16, lid 12 may be more easily removed from its container, it also may be reapplied to reclose the container with a measure of retention capability between the lid and container. This amount of retention capability may be adjusted as desired by adjusting the relative lengths of the segments 26 and 28 of gripping flange 18, or by adjustment and modification of gripping projection 20. For example, gaps may be provided in the generally annular gripping projection 20 if desired, although it is generally preferred for gripping projection 20 to be substantially intact (except for gaps or weakened spots at the crossing points of tear line 24) to provide a better hermetic seal to the container prior to initial opening.

Figure 7:
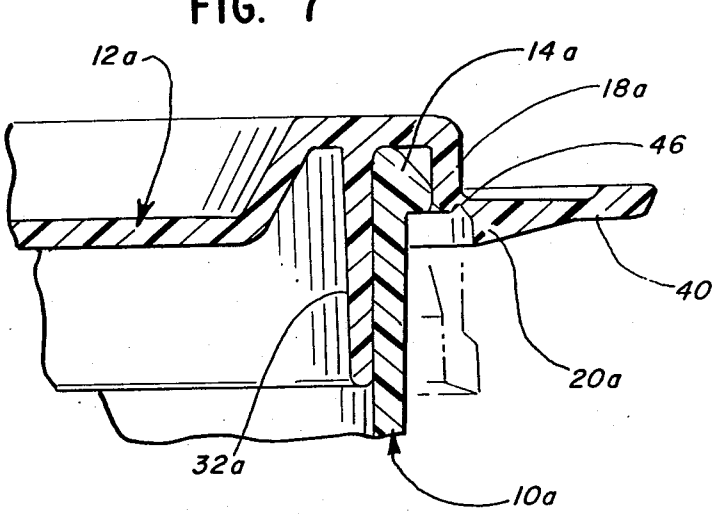
FIG. 7 is a fragmentary section view taken along line 7—7 of FIG. 5.
Figure 5:
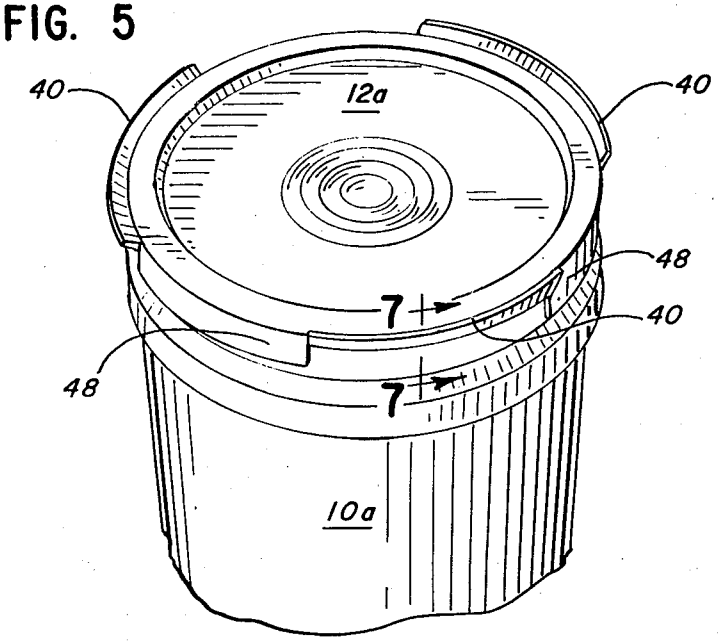
FIG. 5 is an elevational view showing another embodiment of the lid of this invention in a partially opened configuration, and attached to a container lip.
Figure 6:
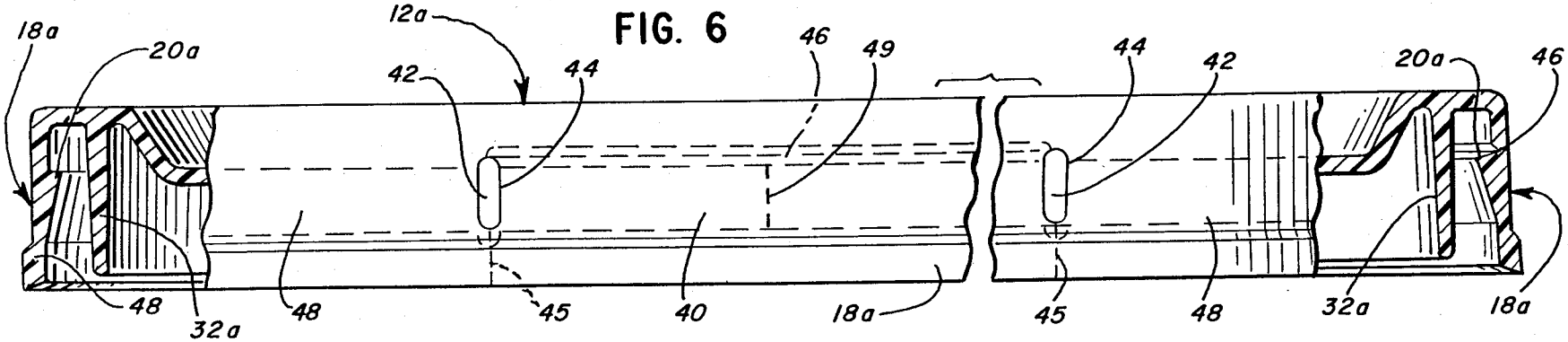
FIG. 6 is an elevational view, with portions shown in section, of the container lid of this invention in its original configuration.

Turning now to FIGS. 5 through 7, another embodiment of the bucket lid of this invention is disclosed. Bucket or other container **10*a* carries molded plastic lid 12*a*. As shown in FIG. 6, lid 12*a* defines an annular peripheral gripping flange 18*a* in a manner generally similar to the previous embodiment, but with the modifications as described below. In this embodiment, gripping flange 18*a* defines a plurality (three being shown) of spaced, circumferential sections 40 of flange 18*a*. Each section 40 has opposed ends which each define a break-away flange portion 42, which may be shown to be generally ovoid sections having a peripheral line of breaking weakness 44 so that each section 42 may be broken away from the remainder of flange 18*a* by a screwdriver, knife or the like. At the same time, one cuts the plastic of gripping flange 18*a* downwardly along lines 45 to free sections 40** at each end.

When that has been accomplished, it becomes possible to rotate each section 40 outwardly and upwardly about line of folding weakness 46. Thus, in sections 40, portions of annular gripping projection **20*a*, which corresponds in structure and function to annular gripping projection 20 of the previous embodiment, may be rotated out of engagement with lip 14*a* of bucket 10*a* as shown in FIG. 1**.

At the same time, other portions 48 of gripping flange **18*a* do not carry a line of folding weakness similar to line 46, and thus do not rotate outwardly. Thus, with respect to portions 48 of gripping flange 18*a*, their sections of annular gripping projection 20*a* remain in engaged relation with lip 14*a* of bucket 10*a*, so that, as in the previous embodiment, when sections 40 are folded outwardly, lid 12*a* still exhibits some retention capability to its container or bucket 10*a***, but is much more easily removable.

Additionally, after opening and and removal of lid **12*a*, it may be snapped back onto lip 14*a* of a bucket for reclosing thereof. When sections 40 have a circumferential extent of about 60°, as shown, they tend to snap upwardly and downwardly with a significant positive snap force. Thus, they can be snapped back into a downward position. If less snap force is desired, sections 40 may each be cut in half along line 49**, for example, reduce the snap action of the sections as they are folded out or in.

Typically, the circumferential extent of two, adjacent, spaced sections 40 plus the other gripping flange portion 48 positioned between them is about 160° or more, preferably at least about 180°. This permits one to lift sections 40 and to easily peel the plastic lid off the container. Sections 40 and flange portion 48 may each typically have a circumferential extent of about 45° to 70°, for greatest opening ease.

As in the previous embodiment, an inner annular retaining flange **32*a* may be provided, having a structure and function similar to retaining flange 32** of the previous embodiment.

Accordingly, by this invention, plastic lids for buckets are provided which can exhibit a good hermetic seal with the bucket to protect the contents, until they are opened. After the opening, the lid is easily removable, but still may exhibit a substantial locking attachment with the bucket rim, for temporary closing and protecting of the contents.

The above has been offered for illustrative purposes only, and is not intended to limit the scope of this invention of this application, which is as defined in the claims below.

That which is claimed is:

1. In a plastic lid for a container which comprises a lid body and an annular, peripheral gripping flange for retaining the lid on the container, the improvement comprising, in combination:

said gripping flange defining at least a pair of spaced, circumferential sections, each section having opposed ends which each define a break-away flange portion, each spaced section defining means permitting outward folding of said section upon breaking away of the connected break-away flange portions.

2. The plastic lid of claim 1 in which said gripping flange defines a substantially continuous, inwardly extending annular gripping projection.

3. The plastic lid of claim 1 in which said break-away flange portions can be completely separated from the remainder of said flange.

4. The plastic lid of claim 1 in which at least three of said spaced sections are present.

5. The plastic lid of claim 1 in which said lid body carries an annular retaining flange positioned coaxially and radially inwardly from said gripping flange and in spaced relation thereto, to define with said gripping flange an annular chamber for receiving a container lip.

6. In a plastic lid for a container which comprises a lid body and an annular, peripheral gripping flange for retaining the lid on the container, the improvement comprising, in combination:

said flange defining at least three substantially uniformly spaced, circumferential sections, each section having opposed ends which each define a break-away flange portion, each spaced section defining means permitting outward folding of said section upon breaking away of the connected break-away flange portions, said gripping flange defining a substantially continuous, inwardly extending annular gripping projection, portions of said projection being carried by said spaced, circumferential sections.

7. The plastic lid of claim 6 in which said lid body carries an annular retaining flange positioned coaxially and radially inwardly from said gripping flange in spaced relation thereto, to define with said retaining flange an annular chamber for receiving a container lip.

8. The plastic lid of claim 7 in which said break-away flange portions can be completely separated from the remainder of said flange.

9. In a plastic lid for a container which comprises a lid body and an annular, peripheral gripping flange for retaining the lid on the container, said gripping flange defining a substantially continuous, inwardly extending annular gripping projection, said gripping flange further defining a substantially annular upper portion and a substantially annular lower portion, and circumferential tear line means to permit tearing separation of said lower portion from the upper portion of the gripping flange, the improvement comprising, in combination:

said tear line means defining a zigzag path circumferentially about said gripping flange, whereby tearing of said lower portion from the upper portion causes removal of spaced portions of said annular gripping projection from the lid without removing all of said gripping projection from the lid, whereby said lid, after removal of the lower portion, is more easily openable, but can still be retained on the container by the remaining portions of said gripping projection.

10. The plastic lid of claim 9 in which four of said spaced portions are present.

11. The plastic lid of claim 10 in which said lid body carries an annular retaining flange positioned coaxially and radially inwardly from said gripping flange and in spaced relation thereto, to define with said gripping flange an annual chamber for receiving a container lip.

12. The plastic lid of claim 9 in which said lid body carries an annular retaining flange positioned coaxially and radially inwardly from said gripping flange and in spaced relation thereto, to define with said gripping flange an annular chamber for receiving a container lip.

* * * * *